US009839860B2

(12) United States Patent
Rakhsha

(10) Patent No.: US 9,839,860 B2
(45) Date of Patent: Dec. 12, 2017

(54) INTERLOCKING CONSTRUCTION TOY

(71) Applicant: Farshad Rakhsha, Beit Shemesh (IL)

(72) Inventor: Farshad Rakhsha, Beit Shemesh (IL)

(73) Assignee: Saturn Enterprises, Inc., Los Angeles, CA (US)

( * ) Notice: Subject to any disclaimer, the term of this patent is extended or adjusted under 35 U.S.C. 154(b) by 0 days.

(21) Appl. No.: 15/149,201

(22) Filed: May 9, 2016

(65) Prior Publication Data

US 2016/0332088 A1 Nov. 17, 2016

Related U.S. Application Data

(60) Provisional application No. 62/159,967, filed on May 12, 2015.

(51) Int. Cl.
*A63H 33/10* (2006.01)
*A63H 33/04* (2006.01)

(52) U.S. Cl.
CPC ..... *A63H 33/101* (2013.01); *A63H 33/04* (2013.01)

(58) Field of Classification Search
CPC ..... A63H 33/04; A63H 33/10; A63H 33/101; A63H 33/102; A63H 33/106; A63H 33/108
See application file for complete search history.

(56) References Cited

U.S. PATENT DOCUMENTS

| | | | | |
|---|---|---|---|---|
| 1,472,536 | A | 10/1923 | Thomson | |
| 2,769,428 | A | 11/1956 | Onanian | |
| 2,885,822 | A | 5/1959 | Onanian | |
| 3,195,266 | A * | 7/1965 | Onanian | A63H 33/101 174/138 D |
| 3,205,611 | A | 9/1965 | Onanian | |
| 3,496,670 | A | 2/1970 | Sloop et al. | |
| 3,545,122 | A | 12/1970 | Onanian | |
| 3,585,752 | A | 6/1971 | Howe | |
| 3,611,609 | A | 10/1971 | Reijnhard | |
| 3,613,291 | A | 10/1971 | Howe | |
| 4,551,110 | A * | 11/1985 | Selvage | A63H 33/10 24/DIG. 53 |
| 5,009,599 | A | 4/1991 | Mueller | |
| 5,211,519 | A * | 5/1993 | Saito | F16B 19/1081 411/45 |

(Continued)

FOREIGN PATENT DOCUMENTS

| | | |
|---|---|---|
| BE | 1010737 | 12/1998 |
| DE | 202004009465 | 10/2004 |

(Continued)

*Primary Examiner* — Gene Kim
*Assistant Examiner* — Alyssa Hylinski
(74) *Attorney, Agent, or Firm* — Heidi Brun Associates Ltd.

(57) ABSTRACT

A kit for a construction toy includes at least two construction blocks, where each construction block includes at least one hole, the at least one hole includes a ridged outer ring and at least one peg sized to fit within the at least one hole to connect between the at least two construction blocks with a cam-releasable snap-on connection, the at least one peg includes at least 2 partially ridged outer rings to engage with the ridged outer ring of the at least one hole when the at least one peg is inserted into the at least one hole to securely hold the at least two construction blocks at a non-parallel angle.

13 Claims, 22 Drawing Sheets

(56) References Cited

U.S. PATENT DOCUMENTS

| | | | | |
|---|---|---|---|---|
| 5,645,464 | A * | 7/1997 | Chen | A63H 33/10 403/300 |
| 5,788,555 | A | 8/1998 | Glynn | |
| 5,924,906 | A | 7/1999 | Grafton | |
| 6,540,461 | B1 * | 4/2003 | Hawang | F16B 21/02 411/41 |
| 6,595,825 | B1 * | 7/2003 | De Wilde | A63H 33/067 403/348 |
| 6,736,691 | B1 * | 5/2004 | Bach | A63H 33/101 446/116 |
| 7,481,692 | B2 * | 1/2009 | Bruder | A63H 33/101 446/111 |
| 7,736,211 | B2 * | 6/2010 | Marzetta | A63H 33/105 446/113 |
| 7,980,912 | B2 * | 7/2011 | Shoptaugh | A63H 33/042 446/120 |
| 8,157,470 | B2 * | 4/2012 | De Wilde | A63H 33/106 403/348 |
| 8,568,187 | B2 * | 10/2013 | Norman | A63H 33/084 273/156 |
| 9,377,042 | B2 * | 6/2016 | De Wilde | A63H 33/101 |
| 2006/0276100 | A1 | 12/2006 | Glickman | |
| 2007/0130874 | A1 | 6/2007 | Teng-fu | |
| 2008/0075528 | A1 | 3/2008 | Marzetta | |
| 2008/0207082 | A1 | 8/2008 | Warner | |
| 2008/0214087 | A1 | 9/2008 | Warner | |
| 2009/0017716 | A1 | 1/2009 | Marzetta et al. | |
| 2011/0039474 | A1 * | 2/2011 | Bruder | A63H 33/101 446/124 |

FOREIGN PATENT DOCUMENTS

| | | | |
|---|---|---|---|
| EP | 0911070 | | 4/1999 |
| FR | 2382254 | | 9/1978 |
| GB | 1238975 | | 7/1971 |
| GB | 2108857 | | 5/1983 |
| JP | 2008212230 | A | 9/2008 |
| KR | 200257670 | | 7/2007 |
| KR | 20100068945 | | 6/2010 |
| WO | 2004067128 | A | 8/2004 |
| WO | 2007021090 | A | 2/2007 |
| WO | 2007120071 | | 10/2007 |
| WO | 2008078942 | | 7/2008 |
| WO | 2010012050 | | 2/2010 |

* cited by examiner

INTERLOCKING CONSTRUCTION TOY

CROSS-REFERENCE TO RELATED APPLICATIONS

This application claims priority from U.S. provisional patent application No. 62/159,967, filed on May 12, 2015, which is hereby incorporated in its entirety by reference.

FIELD OF THE INVENTION

The present invention relates to interlocking construction toys.

BACKGROUND OF THE INVENTION

Toy construction blocks have been popular for many years. The advent and advancement of injection molding plastics technology have resulted in the development of construction block sets such as LEGO (commercially available from the Lego Group), K'NEX (commercially available from K'NEX) and Clics (commercially available from Clics Toys). Each one of these sets has its own unique characteristics such as the geometrical shape of the blocks, the method of connection, the degree of structural stability etc. These unique characteristics introduce particular features of the blocks. For example, in the case of the basic LEGO block sets, two block elements can connect to each other in one direction only (one above the other), or in the case of the Clics blocks, two block elements can connect to each other side-by-side with a 0-90 degree rotation about their common edge. Generally, the block elements of these sets connect to each other without the need for a connecting pin to bring the two elements together. The connection is usually accomplished by incorporating inter-connecting male and female features into the design of each block. There are blocks however, which also use connecting elements.

There are other forms of construction blocks on the market, such as Kapla (commercially available from Kapla Toys), whose blocks are typically larger than those of LEGO etc. which provide the ability to create large structures. Since there is no connection ability between such blocks, the structures created are unstable.

Richard Onanian has created a block and peg combination which is described in the following patents: U.S. Pat. No. 3,205,611; U.S. Pat. No. 3,195,266; U.S. Pat. No. 3,545,122; U.S. Pat. No. 2,885,822 and U.S. Pat. No. 2,769,428.

Other block and peg toys are described in the following publications: US2006276100, DE202004009465U, WO10012050A, KR20100068945, US2009017716A, JP2008212230A, US2008075528A, WO07120071A, US2007130874A, US2008214087A, KR200257670, KR20100068945A, WO10012050A, US2009017716A, WO08078942A, US2008075528A, WO07120071A, WO07021090A, US2008214087A, WO04067128A, US2008207082A and KR200257670Y. They are also described in the patents: U.S. Pat. No. 6,736,691, U.S. Pat. No. 5,924,906A, U.S. Pat. No. 5,788,555A, GB 2108857A, U.S. Pat. No. 3,613,291A, EP 0911070A, BE 1010737A, U.S. Pat. No. 5,009,599A, FR 2382254A, GB1238975A, U.S. Pat. No. 3,585,752, U.S. Pat. No. 3,496,670, U.S. Pat. No. 3,611,609, P 0911070, BE 1010737, U.S. Pat. No. 5,009,599, FR 2382254, GB 1238975, U.S. Pat. No. 3,585,752, U.S. Pat. No. 3,496,670 and U.S. Pat. No. 1,472,536.

SUMMARY OF THE PRESENT INVENTION

There is provided in accordance with a preferred embodiment of the present invention, a kit for a construction toy.

The kit includes at least two construction blocks, where each construction block includes at least one hole which includes a ridged outer ring. The kit also includes at least one peg, sized to fit within a hole of the construction blocks, to connect between two of the construction blocks with a cam-releasable snap-on connection. Each peg includes at least 2 partially ridged outer rings to engage with the ridged outer ring of a hole when the peg is inserted into the hole to securely hold two construction blocks at a non-parallel angle.

Moreover, in accordance with a preferred embodiment of the present invention, the kit also includes an extraction tool. The extraction tool includes a separation element including a thin wedge-like edge to provide mechanical leverage between at least two connected construction blocks and an extraction tip that includes at least a curved and angled surface to engage with a curved and angled undersurface of the peg when engaged with one of the two construction blocks to remove the peg.

Further, in accordance with a preferred embodiment of the present invention, each construction block has multiple surfaces and the at least one hole is positioned on each surface of the construction block.

Still further, in accordance with a preferred embodiment of the present invention, the peg includes two snap-on connections, each connection to connect into one of the holes in the construction blocks, and two pairs of cam-releasable elements, each pair to overcome its associated snap-on connection thereby to enable the peg to be extracted from the construction blocks, and two inner rings, where the snap-on connections are on the inner rings and the cam-releasable elements are on the ridged outer rings of the peg.

Additionally, in accordance with a preferred embodiment of the present invention, the inner rings of the peg include a split lip to catch underneath an extension of an inner ring of a hole of one of the construction blocks and where the halves of the lip are pushed together when the peg is pushed into the hole.

Moreover, in accordance with a preferred embodiment of the present invention, the partially ridged outer rings have at least one tab with a curved and angled undersurface to receive a rotatable, curved and angled uppersurface, the uppersurface providing an upward force against the curved and angled undersurface, thereby to push the peg out of the block.

Further, in accordance with a preferred embodiment of the present invention, the angle is a multiple of the angle of curvature of the arc of the distance between the ridges of the outer ring of the at least one hole and the curvature of the arc of the distance between the ridges of the partially ridge outer ring of the peg and where the angle is pre-determined.

Still further, in accordance with a preferred embodiment of the present invention, each construction block rotates around the peg in increments of the angle.

Additionally, in accordance with a preferred embodiment of the present invention, the shape of the block is square, rectangular, triangular or an arc.

Moreover, in accordance with a preferred embodiment of the present invention, the shape of the block is one of: suns, moons, stars, plants and trees, arches, architraves, balusters, columns, wheels, gear wheels and cogs, spur, helical, double helical, double helical, skew, bevel, spiral bevel, worm, rack and pinion.

Further, in accordance with a preferred embodiment of the present invention, the peg is at least one of: double, triple, quadruple and multi-headed.

Still further, in accordance with a preferred embodiment of the present invention, the shape of the extraction tool is at least one of: elliptical, square, triangular and rectangular.

There is provided in accordance with a preferred embodiment of the present invention, a peg for connecting together two construction blocks. The peg includes two snap-on connections, each connection to connect into a hole in one of the construction blocks, and two pairs of cam-releasable elements, each pair to overcome its associated snap-on connection thereby to enable the peg to be extracted from one of the blocks.

Moreover, in accordance with a preferred embodiment of the present invention, the peg has two inner rings and two outer rings and the snap-on connections are on the inner rings and the cam-releasable elements are on the outer rings.

Further, in accordance with a preferred embodiment of the present invention, the outer rings have at least one tab with a curved and angled undersurface to receive a rotatable, curved and angled uppersurface, the uppersurface providing an upward force against the curved and angled undersurface, thereby to push the peg out of the block.

Still further, in accordance with a preferred embodiment of the present invention, the peg is at least one of: double, triple, quadruple and multi-headed.

There is provided in accordance with a preferred embodiment of the present invention, an extraction tool for extracting a peg from a construction block. The extraction tool includes an extraction tip that includes at least a curved and angled surface to engage with a curved and angled undersurface of the peg and a separation element that includes a thin wedge like edge to provide mechanical leverage.

Moreover, in accordance with a preferred embodiment of the present invention, the shape of the extraction tool is at least one of: elliptical, square, triangular and rectangular.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
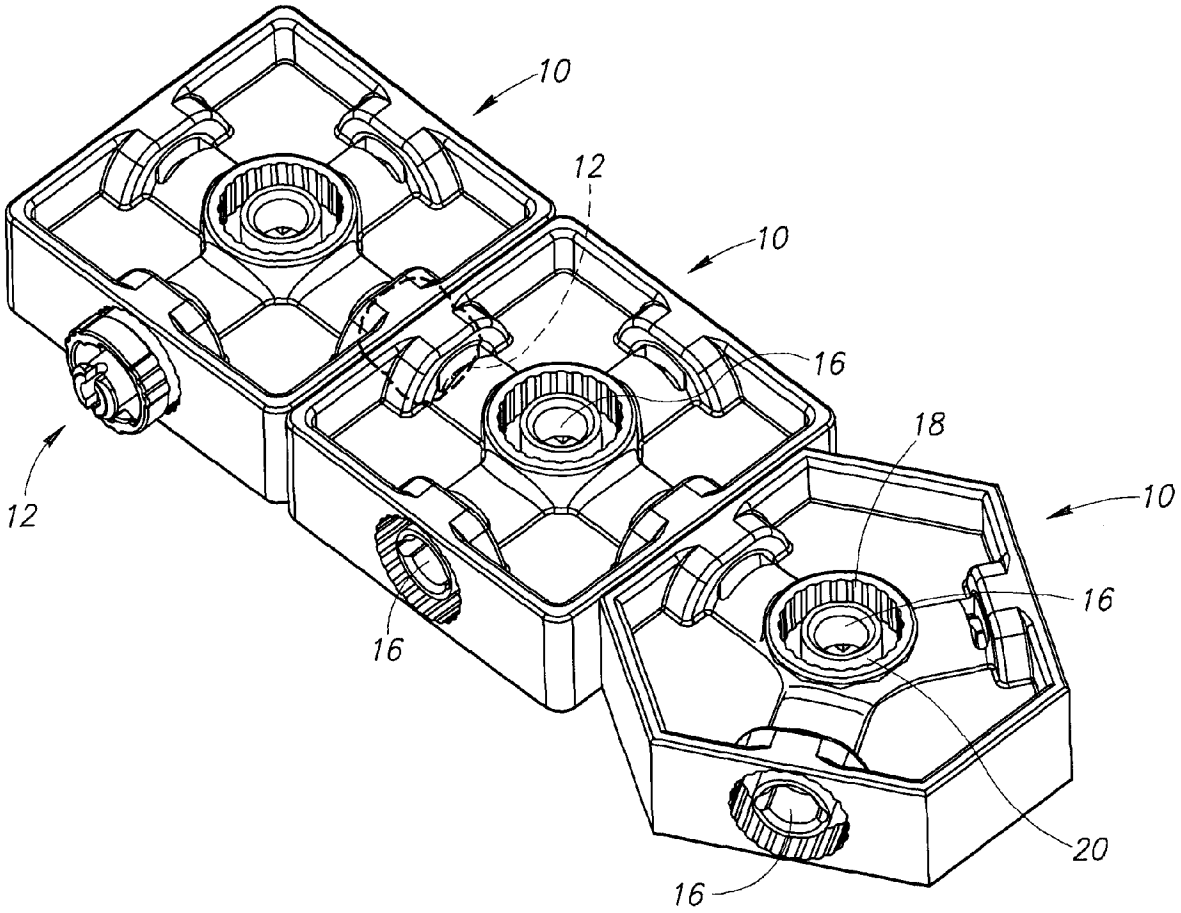
FIG. 1 is a schematic illustration of three blocks held together by pegs, constructed and operative in accordance with a preferred embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicant has realized that certain features of pegs and construction blocks may be designed to allow for blocks to be connected on all sides. Applicant has further realized that particular features may be implemented within both the pegs and the blocks to provide a large connection force between the different elements and thus enable the construction of large and stable structures.

There is provided, in accordance with an embodiment of the present invention, a selection of differently shaped construction blocks 10 together with pegs 12, as shown in FIG. 1 to which reference is now made. The different shapes may include but are not limited to square, rectangular, triangular and arc-shaped blocks, as described in more detail herein below. FIG. 1 illustrates two square shaped blocks and a triangular shaped block connected in series using pegs 12. It will be appreciated that typical dimensions for a square block may be 30 mm by 30 mm by 10 mm high. It will be appreciated that when two blocks 10 are connected together by a peg 12, peg 12 may be hidden as is illustrated by the dotted lines in FIG. 1.

Each peg 12 may be used to connect together any two blocks 10. An extraction tool 14 (described in more detail with respect to FIGS. 6A and 6B) may be used to extract a peg 12 which was previously inserted in to a block 10.

It will be appreciated that each individual block 10 may comprise a number of insertion holes 16. Each hole 16 may be situated on a different side of block 10 as well as on the upper and lower surfaces of a block 10. The latter are typically in the geometrical center of the upper and/or lower surfaces. It will also be appreciated that arc shaped blocks 10 do not have a geometrical center and that the formation of holes 16 may be a particular pattern of facing of the holes 16 from the sides. The number of holes 16 to a block 10 may vary according to the shape and size of block 10.

Each insertion hole 16 may comprise a ridged outer ring 18 and a non-ridged flat inner ring 20. Ridged outer ring 18 may allow for the insertion and turning of peg 12 as is described in more detail herein below. Flat inner ring 20 may extend a distance D to a lower ledge 22 as is shown in FIGS. 3A and 3B.

Figure 2A:
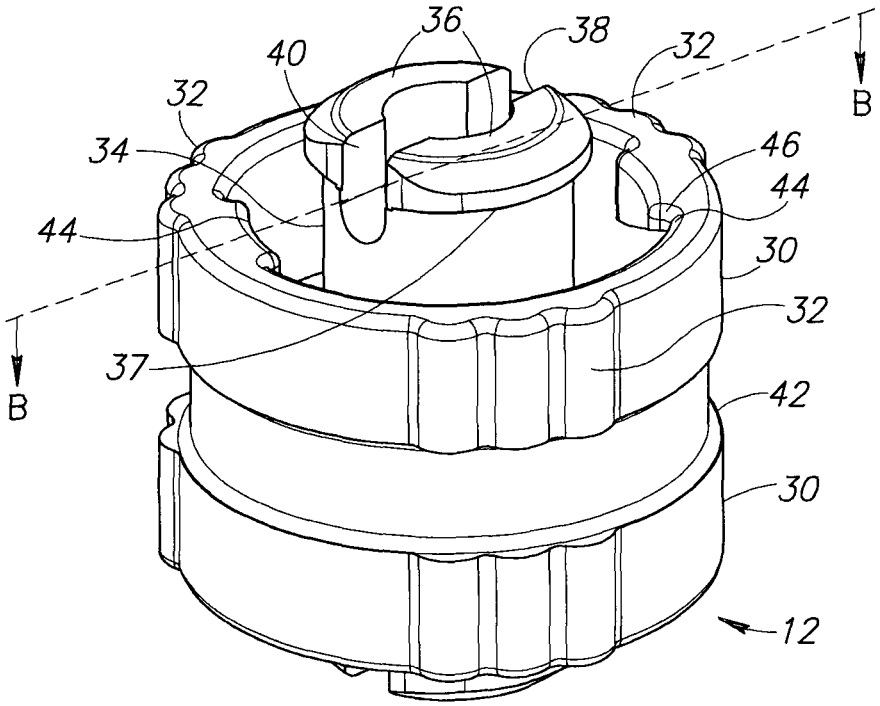
FIGS. 2A and 2B are enlarged schematic illustrations of the peg of FIG. 1, constructed and operative in accordance with a preferred embodiment of the present invention.
Figure 2B:
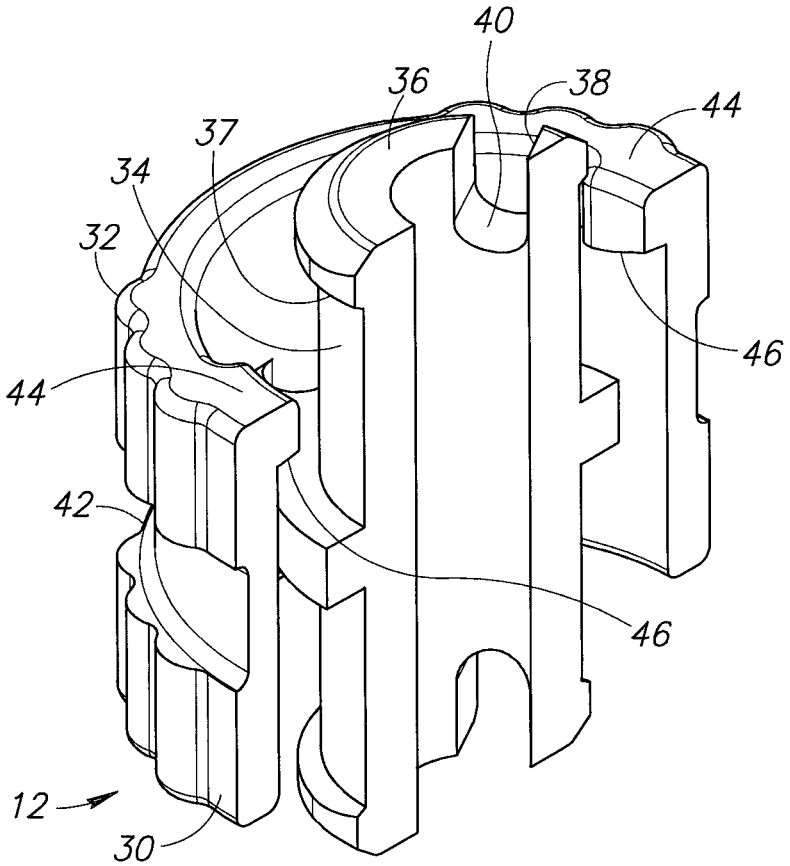

Reference is now made to FIG. 2A which illustrates a single peg 12. As is shown, peg 12 is symmetrical and each peg 12 may comprise two outer rings 30, four tabs 44 (only two are visible in FIG. 2A) and two inner rings 34 (only one is visible in FIG. 2A). Inner ring 34 is described in more detail in relation to FIG. 7A. Each tab 44 may extend towards its inner ring 34 and may have a curved and angled undersurface 46 as is illustrated in FIG. 2B to which reference is now made. Each outer ring 30 may have partially ridged edges 32. Each inner ring 34 may further comprise a lip 36 split into two halves with a channel 40 between the two halves. Each channel 40 may allow for the two halves of lip 36 to be squeezed together as is described herein below.

Figure 3A:
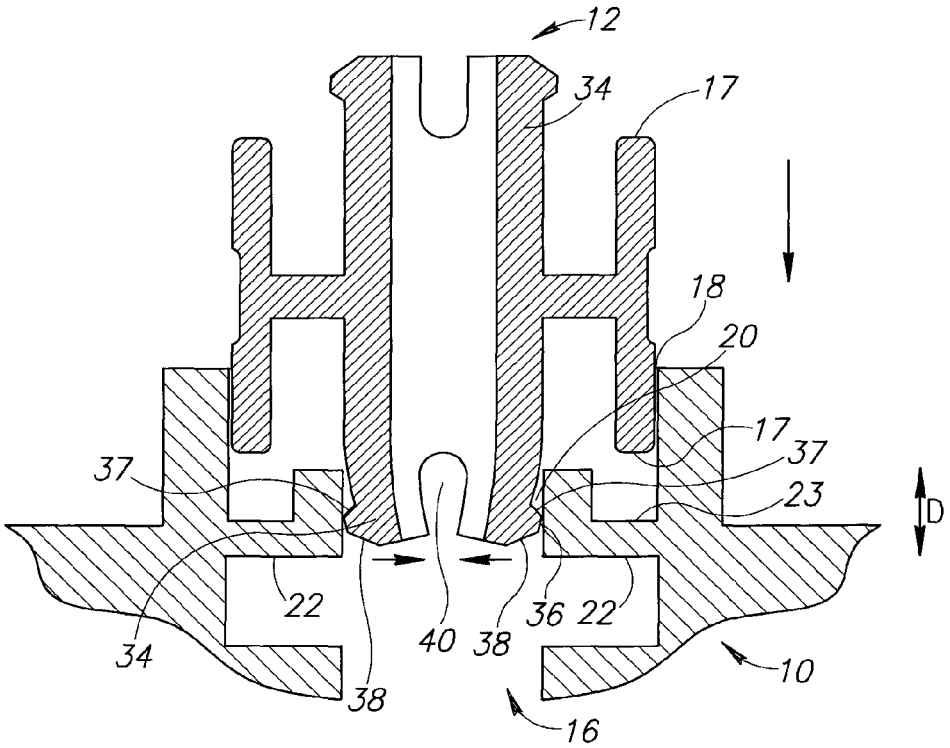
FIGS. 3A and 3B are schematic illustrations of the insertion of a peg within a block, constructed and operative in accordance with a preferred embodiment of the present invention.
Figure 3B:
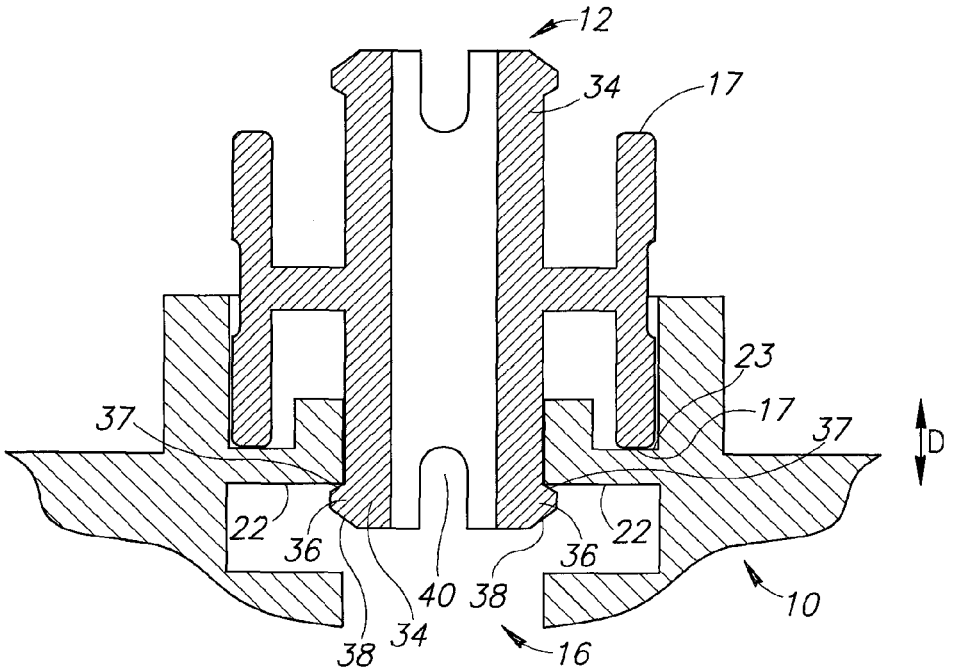

It will be appreciated that a user may insert peg 12 into hole 16, as shown in FIGS. 3A and 3B to which reference is now made, and may continue pushing downwards with some force. This downwards force may push the relevant inner ring 34 and lip 36 of peg 12 into inner ring 20 of hole 16 in block 10. Lip 36 may have an angled uppersurface 56 and an angled lower surface 38 which may aid the insertion of peg 12 into inner ring 20.

It will be appreciated that the downward force on peg 12, once inserted into hole 16, may cause the two halves of lip 36 to be pressed towards each other, thereby shrinking channel 40 as is illustrated in FIG. 3A. Once inner ring 34 of peg 12 has traveled length D within inner ring 20 of block 10, it may encounter ledge 22. At this point, there is room for the two halves of lip 36 to spread out and each catch underneath a ledge 22 with a snap, thus holding peg 12 in place within hole 16, as illustrated in FIG. 3B. In addition, a top 17 of outer ring 30 of peg 12 may bump up against an upper ledge 23 between ridged outer ring 18 and flat inner ring 20 of block 10 to ensure peg 12 comes to a stop in its correct position once it has been inserted.

Figure 4A:
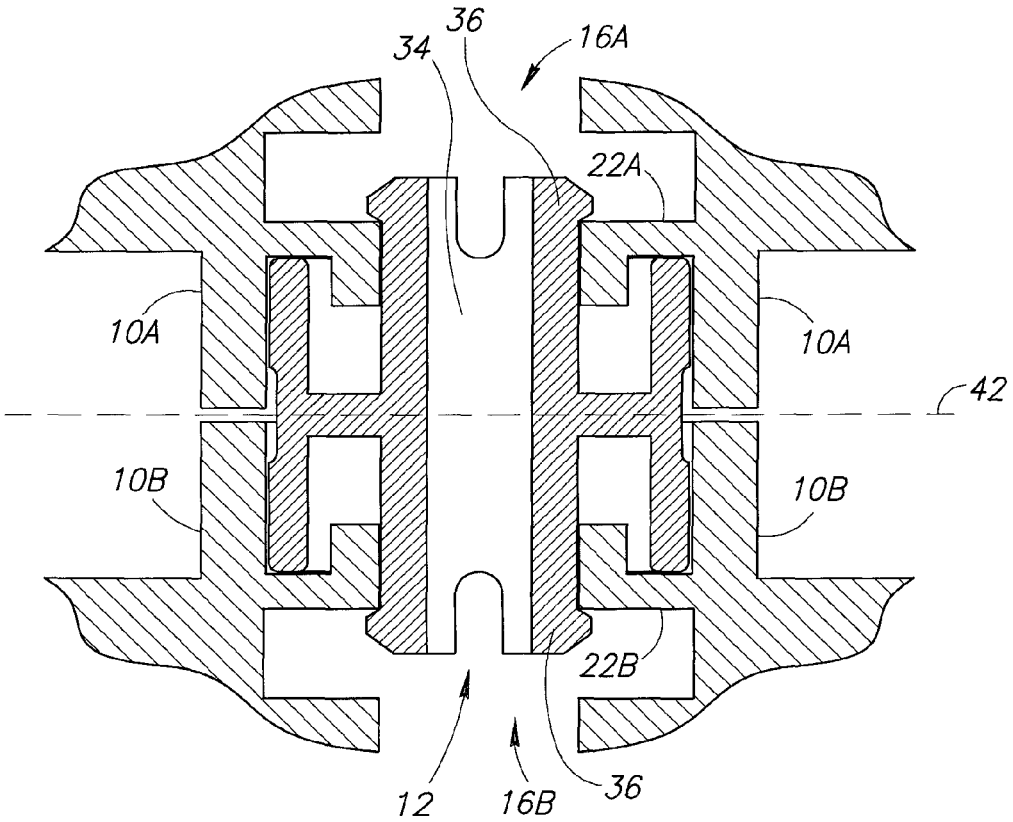
FIG. 4A is a schematic illustration of a single peg connecting two blocks, constructed and operative in accordance with a preferred embodiment of the present invention.

It will be further appreciated that since the two halves of lip 36 catch under ledge 22, peg 12 may be firmly held within block 10. Accordingly peg 12 may be used to connect two blocks 10 to each other Reference is now made to FIG. 4A which illustrates how peg 12 may be symmetric around an axis 42 and thus may connect two blocks 10A and 10B. One half of peg 12 may be inserted into a hole 16A of block 10A and the other half may be inserted into a hole 16B of block 10B. As is shown, due to the two halves of lip 36 catching under ledges 22A and 22B, peg 12 may be firmly locked into position between blocks 10A and 10B.

Figure 4B:
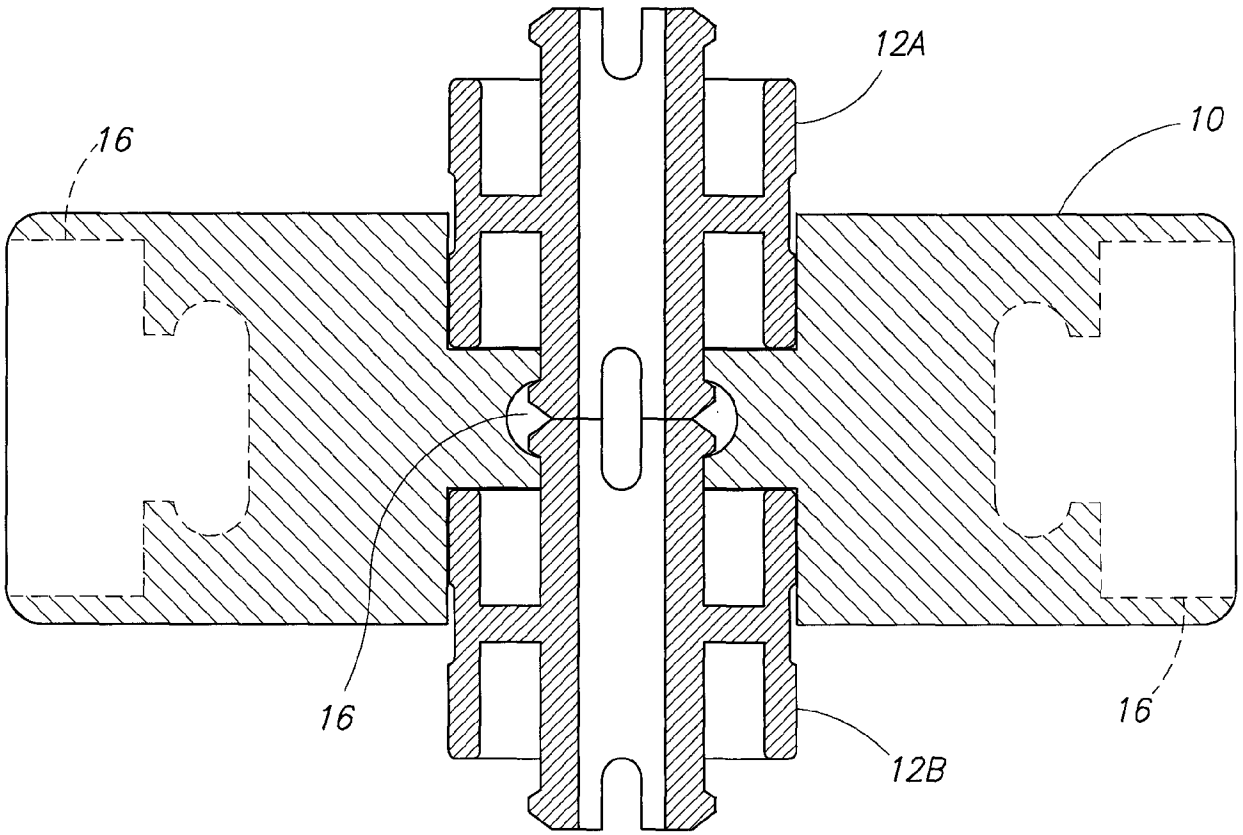
FIG. 4B is a schematic illustration of how two pegs may be inserted within the same block, constructed and operative in accordance with a preferred embodiment of the present invention.

Reference is now made to FIG. 4B which illustrates how a single block 10 may accommodate more than one peg 12 in a hole 16 at any one time (in this scenario pegs 12A and 12B are connected from either side of block 10). It will be appreciated that the number of pegs that can be inserted into block 10 may depend on the number of holes 16 available.

Figure 5A:
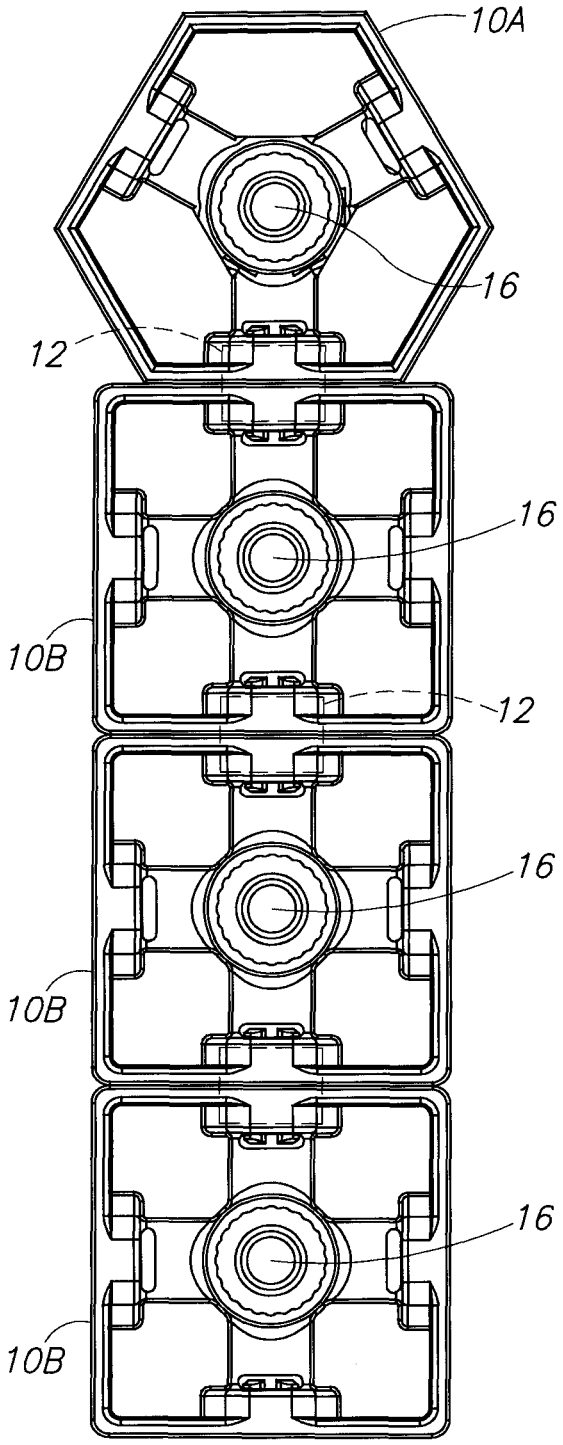
FIGS. 5A, 5B and 5C are schematic illustrations of the different permutations of connection blocks with pegs, constructed and operative in accordance with a preferred embodiment of the present invention.

Reference is now made to FIGS. 5A, 5B, 5C, 5D, 5E and 5F which illustrate how differently shaped blocks 10 may be connected together in different ways using pegs 12. It will be appreciated that this ability is due to the uniformity of size of holes 16 over all types of blocks 10. FIG. 5A shows blocks 10 connected in series.

Figure 5B:
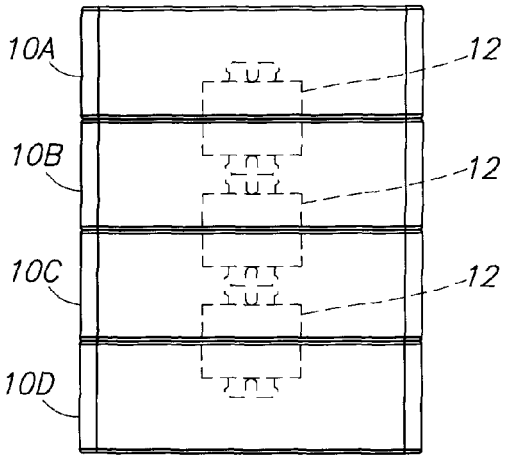

It will be further appreciated that, since hole 16 may also be located within the upper and lower surfaces of block 10, different blocks 10 may also be "stacked" as is illustrated in FIG. 5B.

Figure 5C:
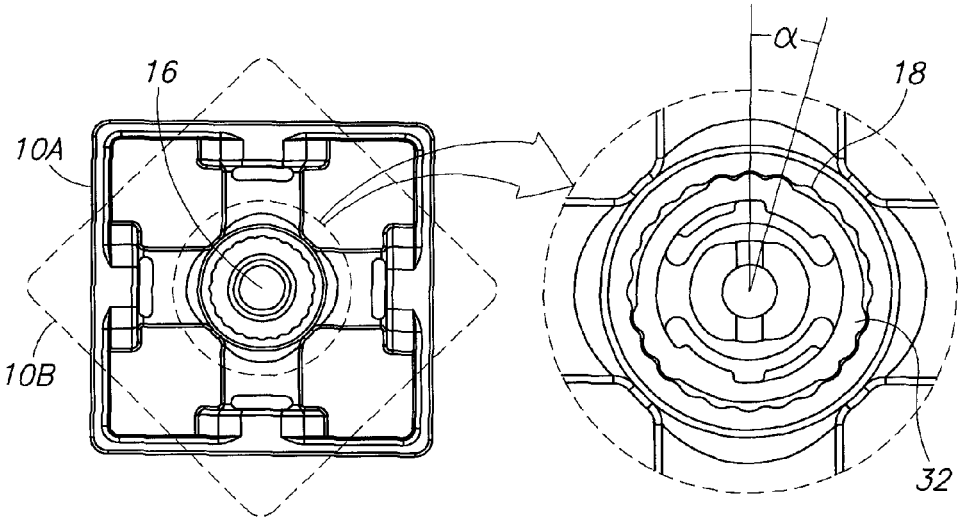

It will also be appreciated that once peg 12 is held in place within hole 16, ridges 32 (FIG. 2A) of peg 12 may engage with ridges 18 (FIG. 1) of hole 16, enabling peg 12 to turn and to remain in place at a particular angle, thereby allowing two blocks 10A and 10B to be connected at an angle to each other, as is illustrated in FIG. 5C. It will also be appreciated that the width of ridges 18 and 32 may be predetermined and may span a small angle $\alpha$, which may be an integral fraction of a full circle (i.e. 360°). For example, the small angle $\alpha$ might be 15°.

Figure 5D:
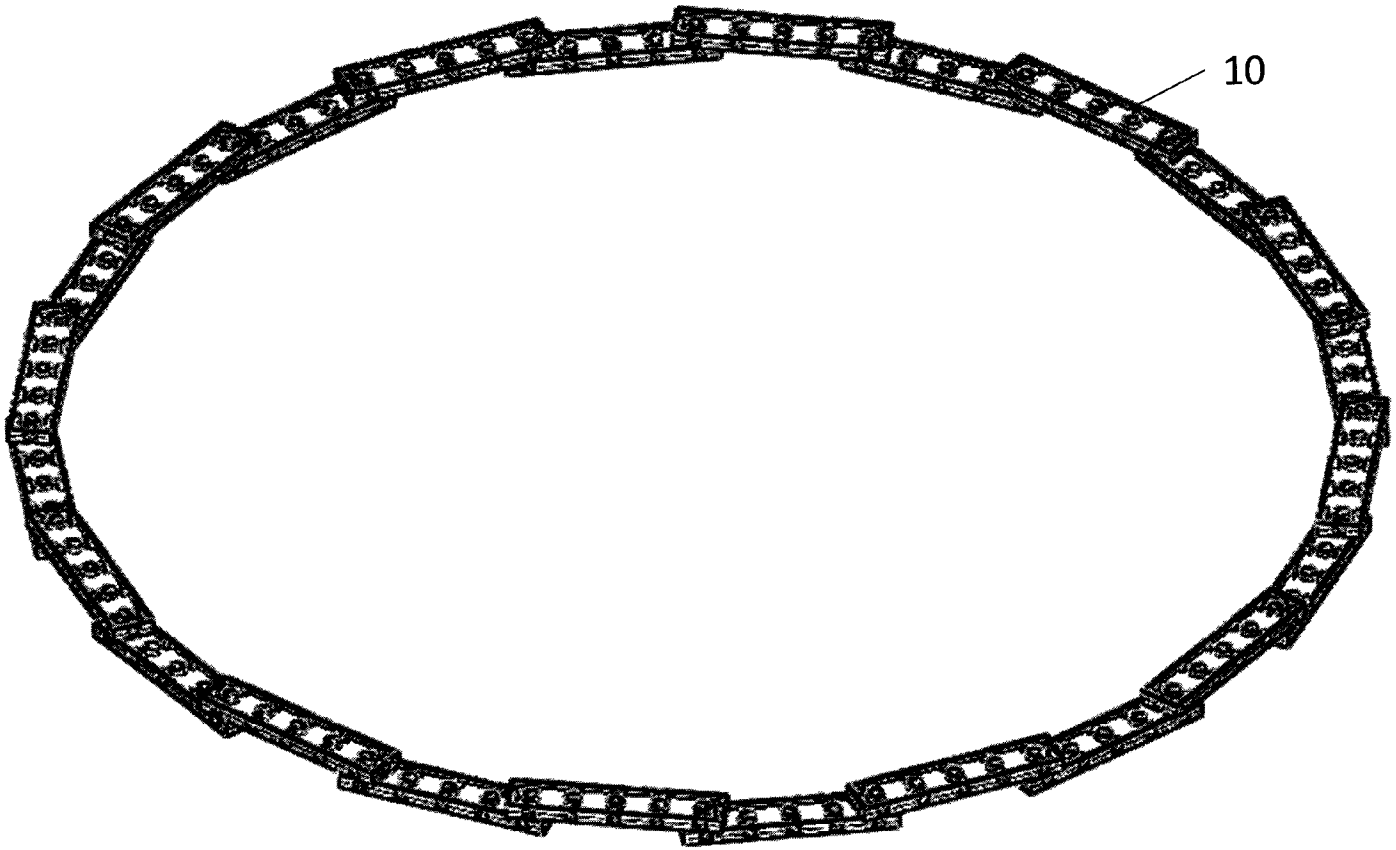
FIGS. 5D, 5E and 5F are schematic illustrations of the use of angles between connection blocks, constructed and operative in accordance with a preferred embodiment of the present invention.
Figure 5E:
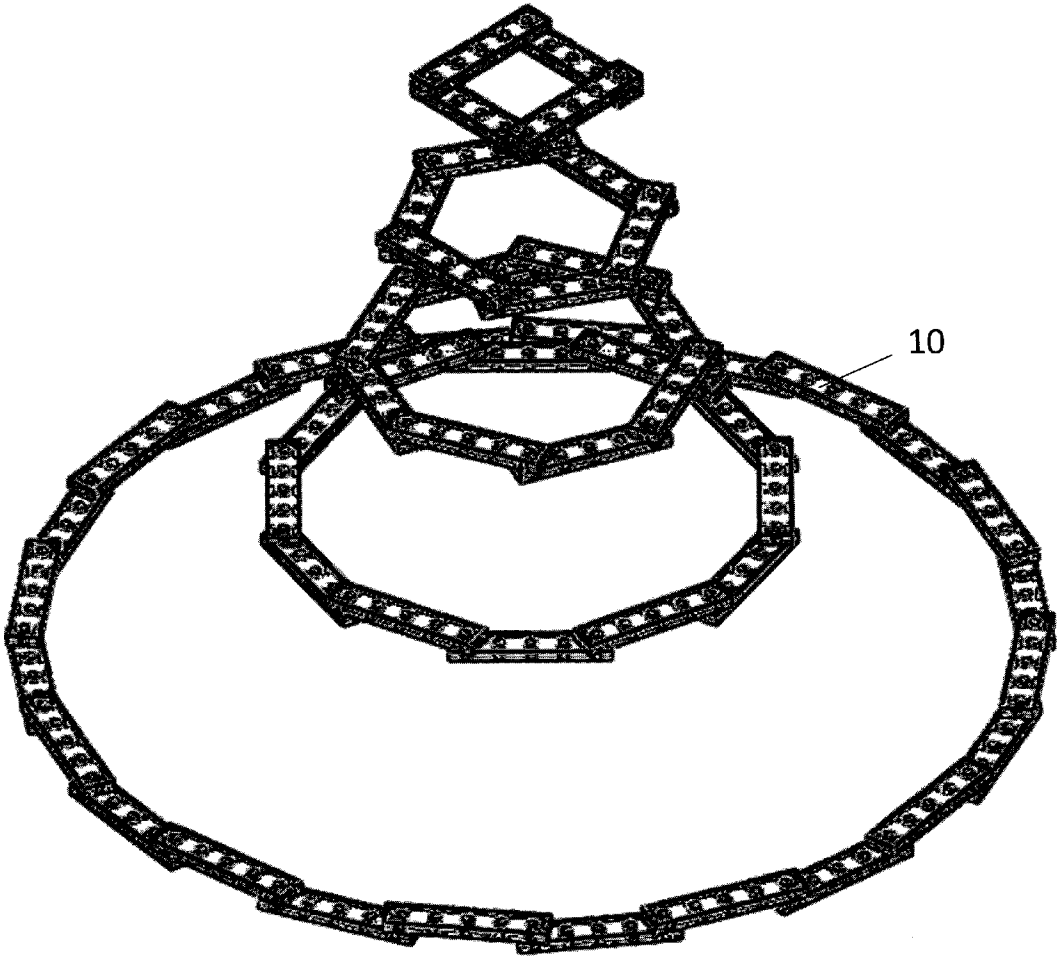
Figure 5F:
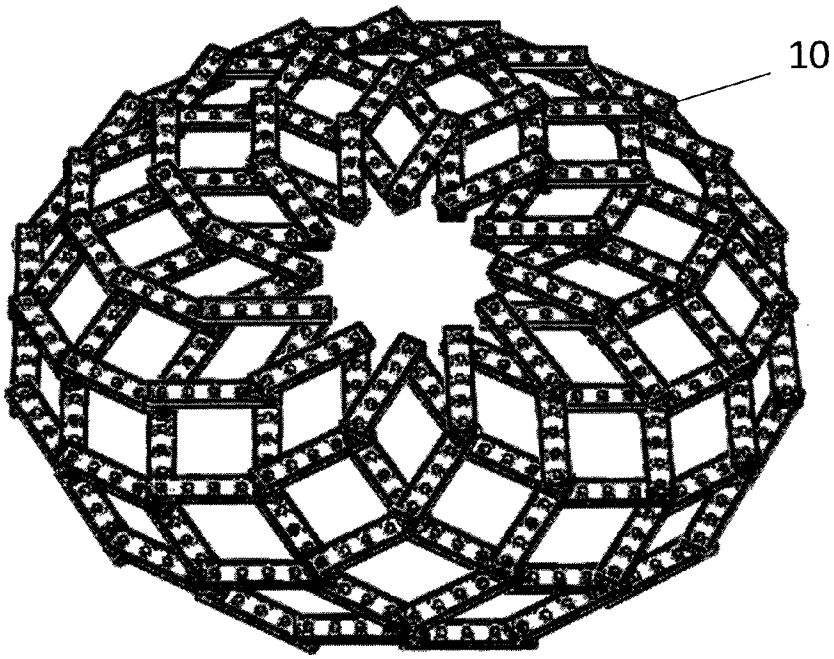

The particular angle that a user may choose to have between any two of his/her blocks will be a multiple of angle $\alpha$. It will be appreciated that the blocks will be held securely at the selected angle by the engagement of the two sets of ridges 18 and 32. This may enable a user to create strongly angled structures as well as sturdy structures with curved surfaces, as is illustrated in FIGS. 5D, 5E and 5F. In FIG. 5D, each block 10 is rotated at exactly the same angle in order to create a perfect circle. FIGS. 5E and 5F show how other shapes, with other angles, may also be created with the same precision.

Thus, rectangular blocks 10 (for example) may be used to create constructions having curvatures (including 3D objects) without the need for a purposely designed shaped block 10 in order to provide the desired curvature.

Figure 6A:
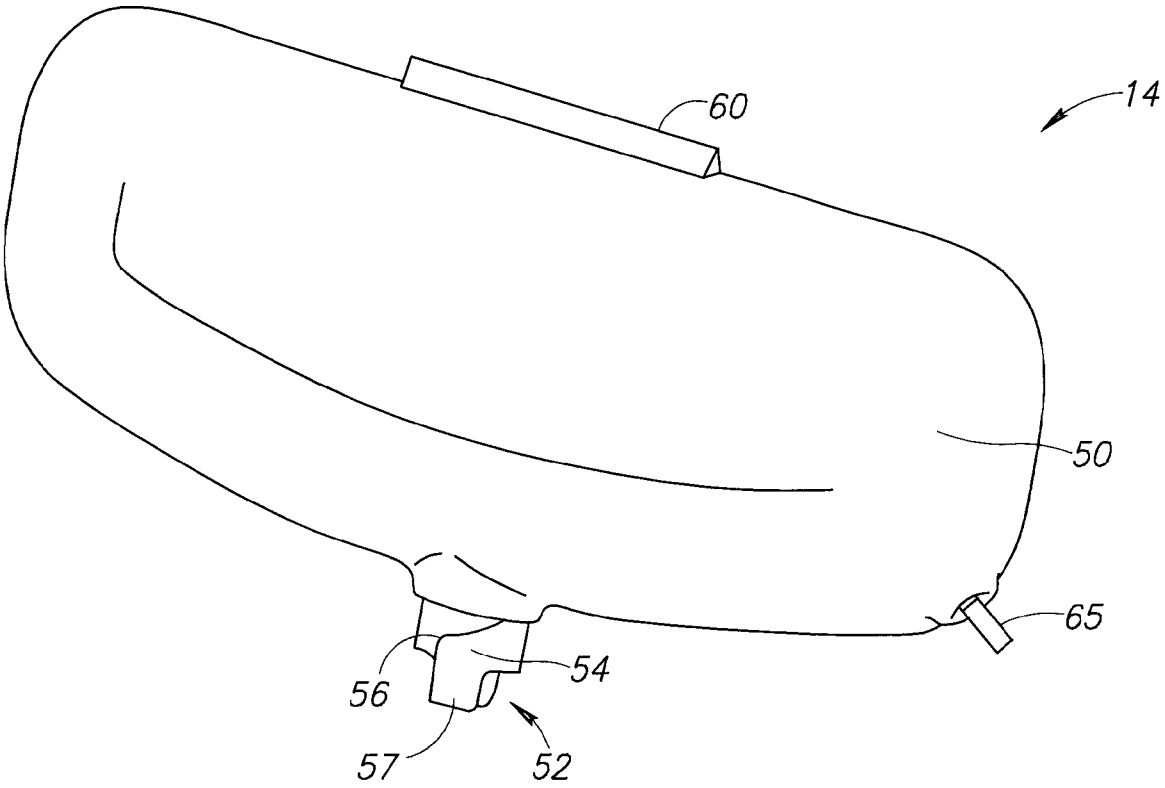
FIG. 6A is a schematic illustrations of an extraction tool, constructed and operative in accordance with a preferred embodiment of the present invention.

It will be also appreciated that, when separating two adjoined blocks 10 from each other, the first block 10 may be manually pulled off peg 12, blocks 10 generally being of a suitable size to allow for a hand to grip them. It will be further appreciated that once the two adjoined blocks 10 have been separated, peg 12 may be too small for human hands to easily remove it from the second block 10. Reference is now made to FIG. 6A which details an extraction tool 14 designed to pull peg 12 out of hole 16 and thus out of block 10. Extraction tool 14 may comprise a handle 50, which may be of any suitable size and shape but may be large enough for a hand to hold and to twist it, an extraction tip 52, a separation element 60 and an insertion tip 65. Insertion tip 65 may be used, if needed, to insert and guide peg 12 into hole 16. Extraction tip 52 may further comprise two active surfaces 54 which may be curved elements with a curved and angled uppersurface 56 (only one active surface is shown in FIG. 6A). Each surface 54 comprises a protrusion 57. It will be appreciated that the function of protrusion 57 is to guide extraction tip 52 into hole 16.

Figure 6B:
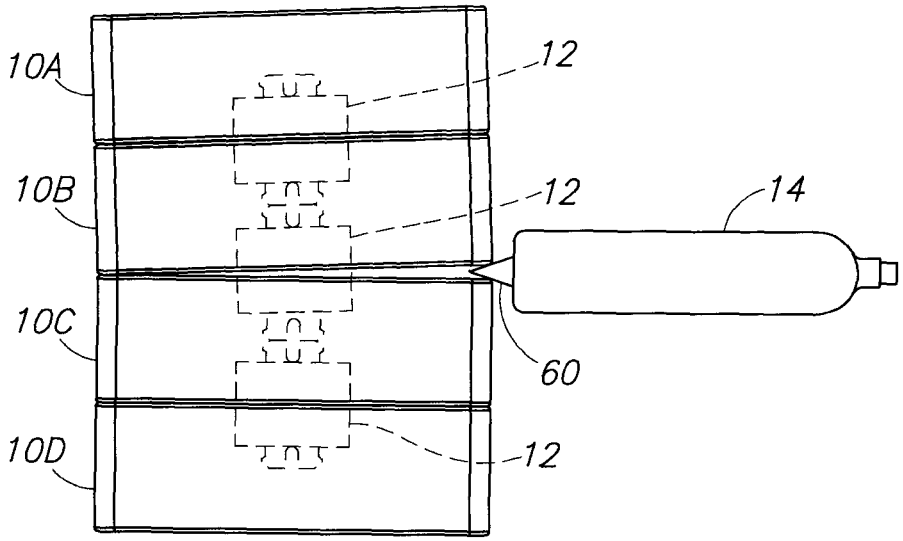
FIG. 6B is a schematic illustration of the use of the extraction tool of FIG. 6A to provide mechanical leverage when manually separating two adjoined blocks, constructed and operative in accordance with a preferred embodiment of the present invention.

As is illustrated in FIG. 6B to which reference is now made, separation element 60 may have a thin wedge-like edge and may be used to provide mechanical leverage when manually separating two adjoined blocks 10.

Figure 7A:
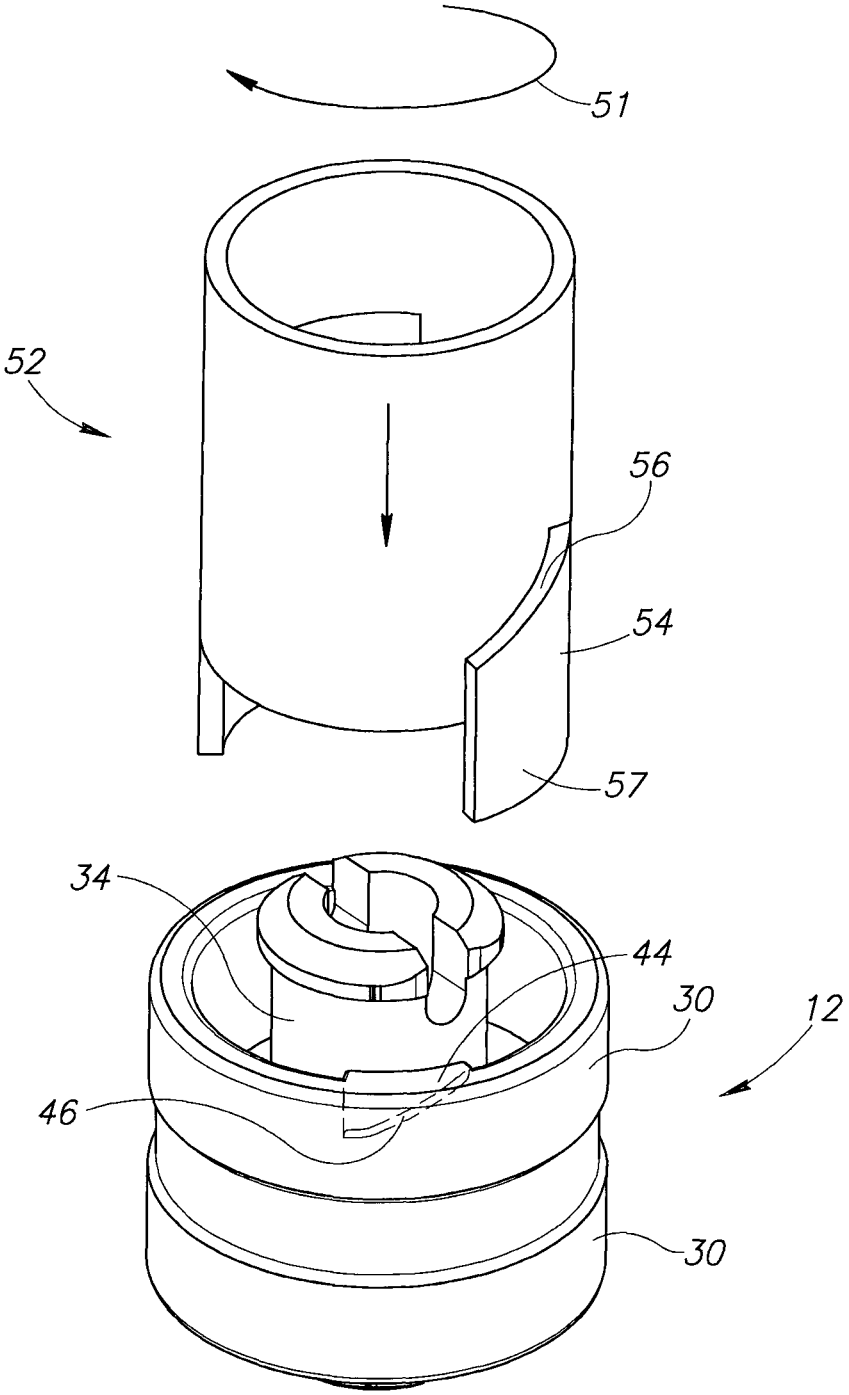
FIGS. 7A, 7B and 7C are schematic illustrations of the use of the extraction tip of the extraction tool of FIG. 6A when extracting an inserted peg, constructed and operative in accordance with a preferred embodiment of the present invention.
Figure 7B:
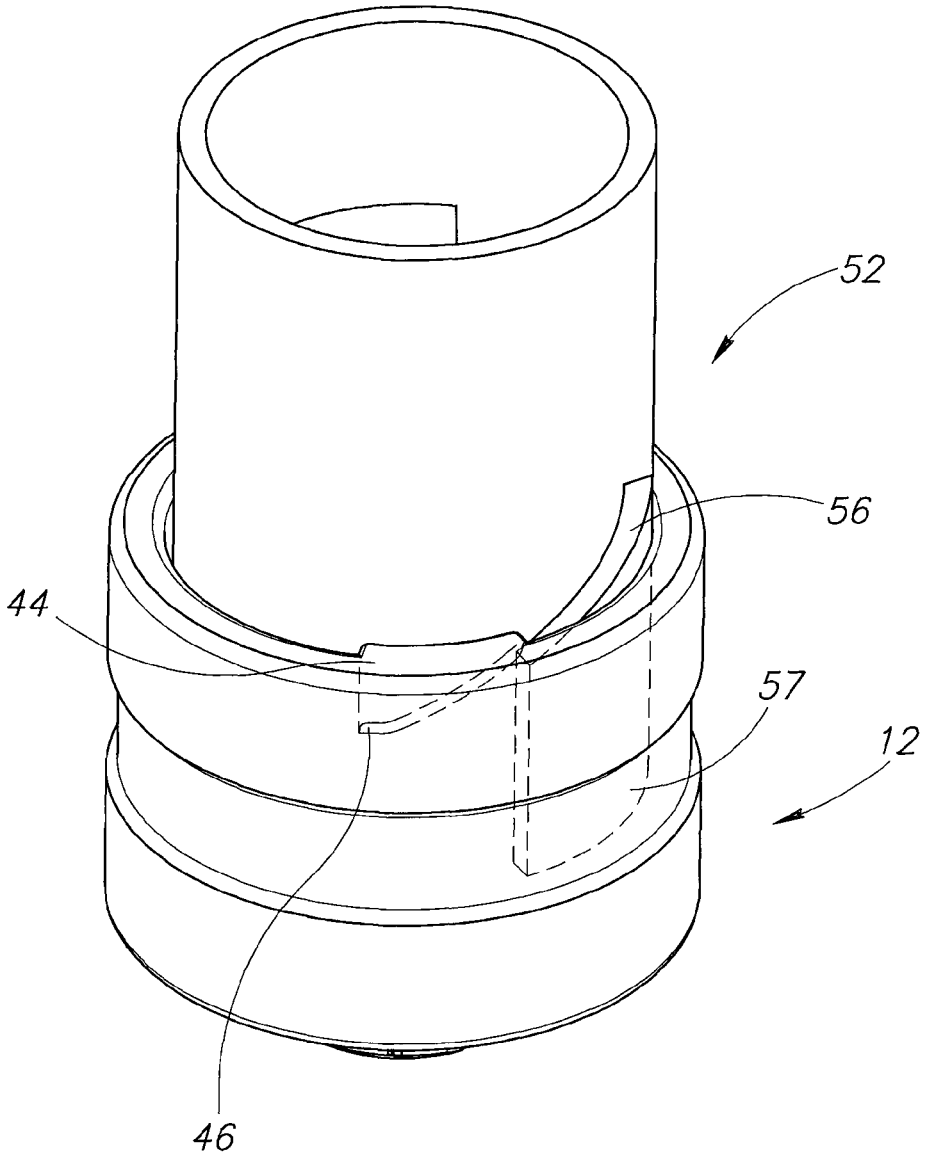
Figure 7C:
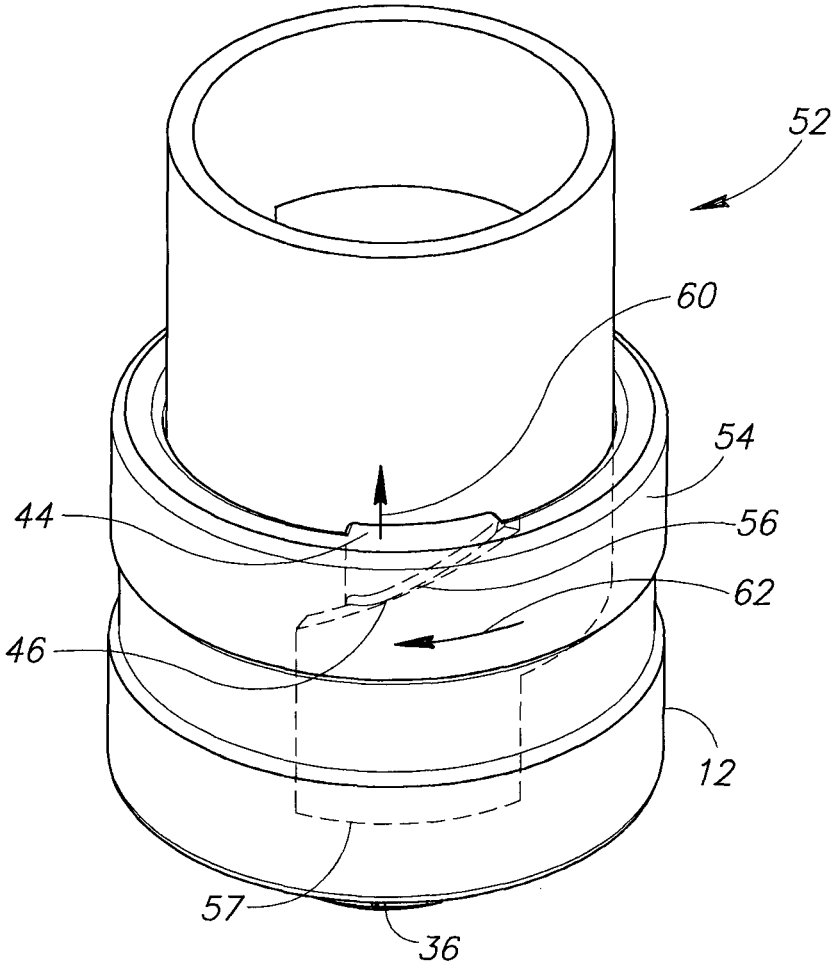

Reference is now made to FIGS. 7A, 7B and 7C which show extraction tip 52, in use with peg 12. In FIG. 7A, extraction tip 52, with its curved and angled uppersurface 56, is positioned above peg 12 ready to be lowered and pushed into peg 12.

It will be appreciated that a user may insert extraction tip 52 by pushing it into peg 12 and twisting it slightly according to arrow 51 so that each curved and angled uppersurface 56 may engage curved and angled undersurface 46 of tab 44 as is seen in FIG. 7B. As can be seen, extraction tip 52 may fit between outer ring 30 and inner ring 34 such that curved and angled uppersurfaces 56 may engage under curved and angled undersurfaces 46.

FIG. 7C illustrates how extraction tip 52 may be twisted in the direction of tab 44 along curved and angled undersurface 46. Curved and angled uppersurface 56 may push curved and angled undersurface 46 in a motion similar to that of a cam pushing a moveable surface. It will be appreciated that rotating extraction tip 52 may cause curved and angled uppersurface 56 to rotate and push against the curved undersurface of tab 44 and in the process push tab 44 upwards in the direction of arrow 60. The rotation of extraction tip 52 is indicated by arrow 62.

It will be further appreciated that since the two surfaces (46 and 56) are engaged, the upper motion in the direction of arrow 60 may overcome the force of connection of lip 36 caught underneath ledge 22 as was illustrated in FIG. 3B. It will be appreciated that, as extraction tool 14 pulls peg 12 upwards, the strong upper motion may force the two halves of lip 36 to be squeezed against each other, thus allowing peg 12 to be pulled upwards, in a motion similar to that illustrated in FIG. 3A, out of hole 16 and out of the pertinent block 10 to which it was inserted. It will be further appreciated that angled surfaces 37 and 38 of lip 36 may aid the upward movement of peg 12.

It will be appreciated that peg 12 and extraction tool 14 may be made from very strong plastics such as Delrin 100P for peg 12 and ABS (acrylonitrile butadiene styrene) for extraction tool 14, strong enough to survive almost unlimited insertions and extractions. They may be manufactured by methods such as injection molding and 3D printing.

It will be further appreciated that peg 12 may be subjected to both a snap-on insertion motion (via the two halves of lip 36 and channel 40 there between) and a cam-releasable extraction motion (via tab 44 and extraction tip 52) due to the cam-releasable elements of peg 12 in order to release lip 36 from underneath ledge 22. This combination enables peg 12 to be easily inserted into and extracted out of block 10 and also enables a very strong connection due to the fact that lip 36 may be caught underneath ledge 22. It will be appreciated that this snap-on connection may generally only be overcome using the cam-releasable extraction motion provided by extraction tool 14.

Further, inner ring 20 of block 10 may enable the insertion of peg 12 and the connection between two blocks 10 while outer ring 18 may enable the relative rotation of two blocks 10.

Figure 8A:
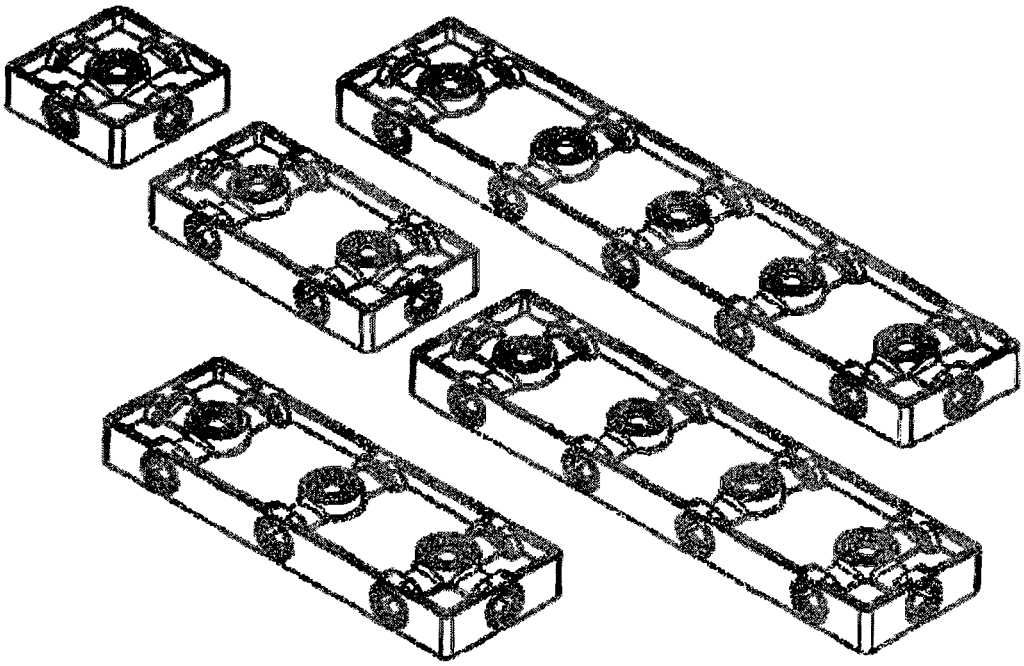
FIGS. 8A and 8B are schematic illustrations of examples of different sizes of rectangular blocks constructed and operative in accordance with a preferred embodiment of the present invention.
Figure 8B:
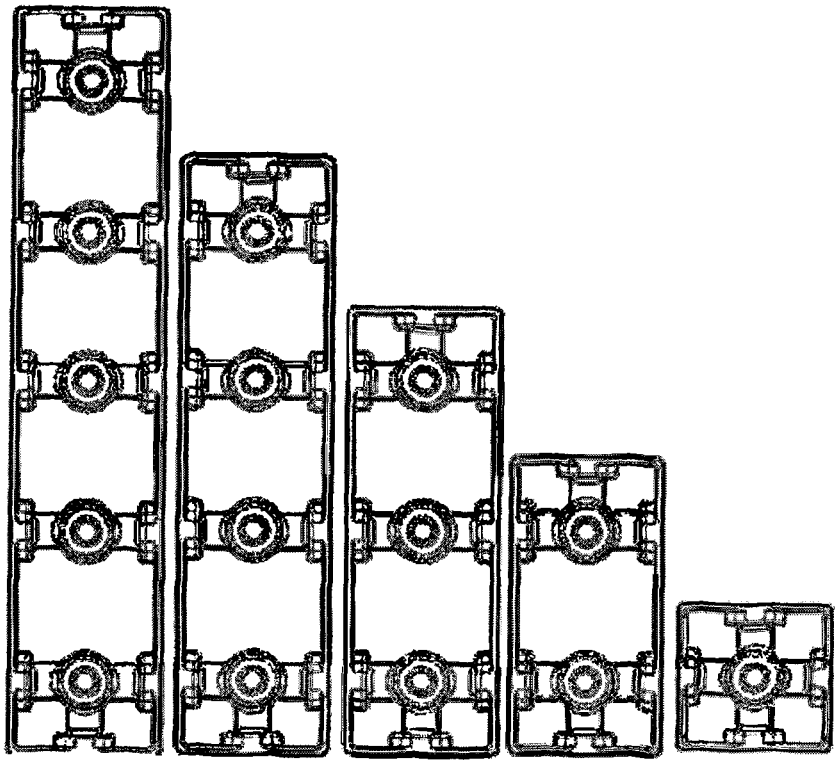
Figure 9A:
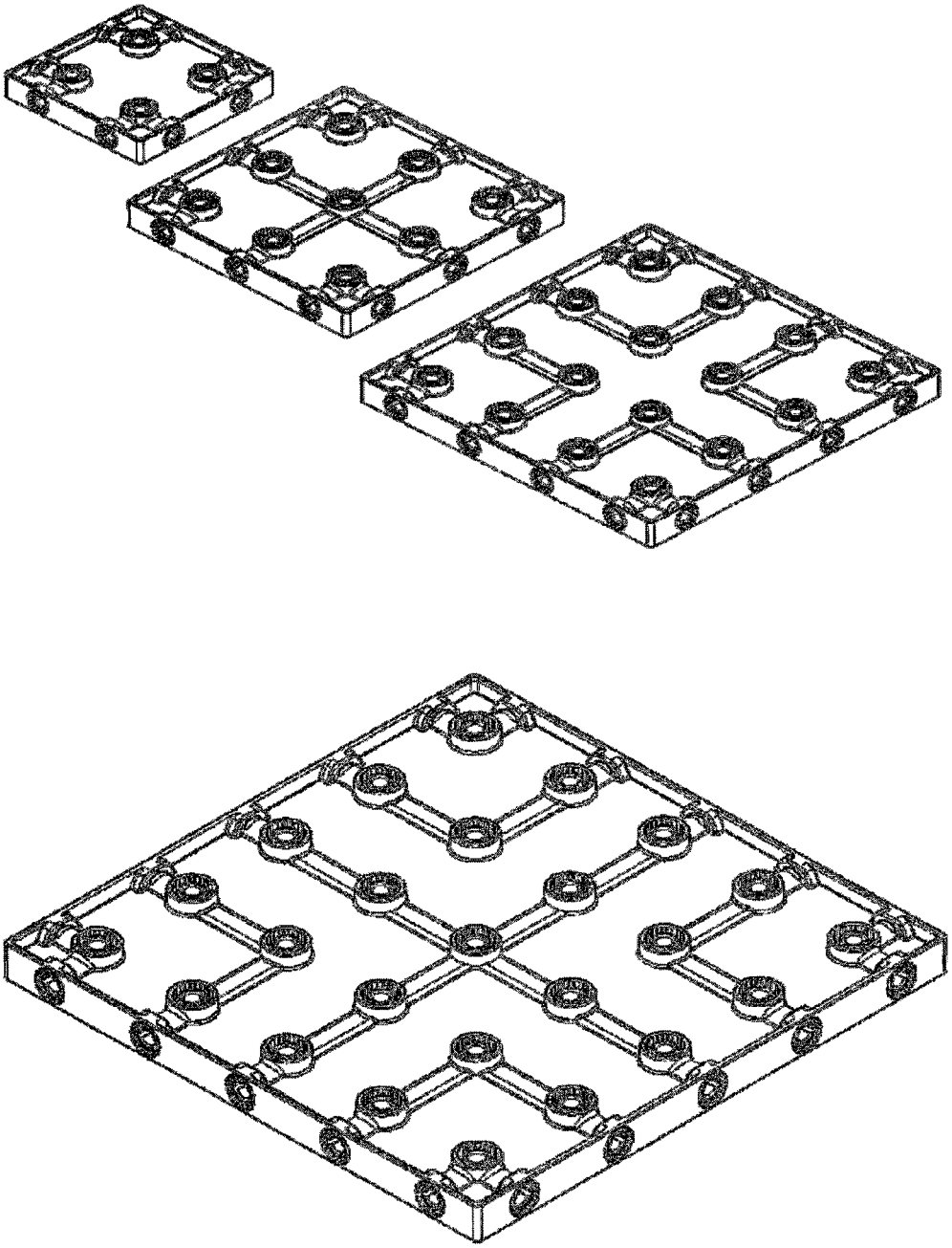
FIGS. 9A and 9B are schematic illustrations of examples of different sizes of square blocks, constructed and operative in accordance with a preferred embodiment of the present invention.
Figure 9B:
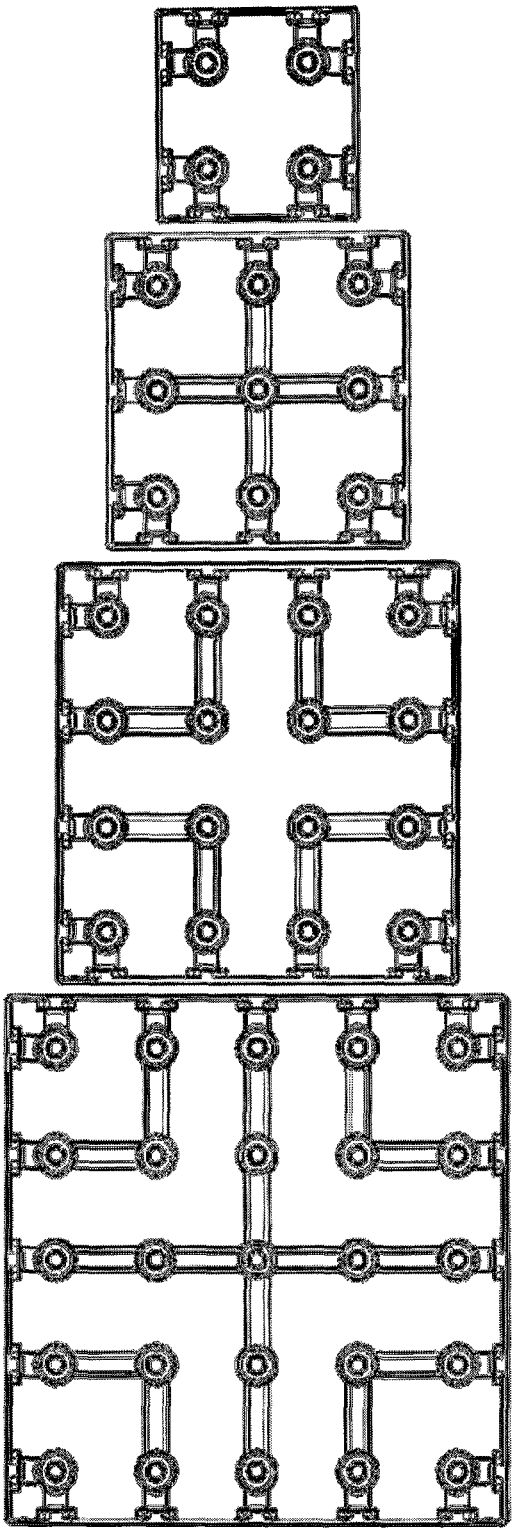
Figure 10A:
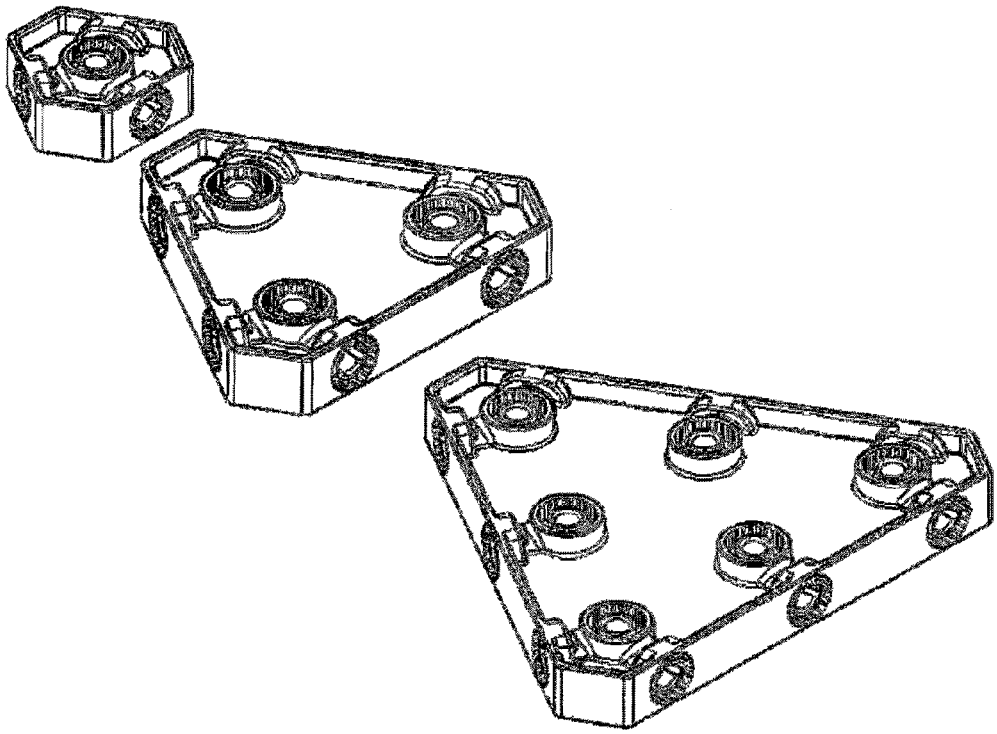
FIGS. 10A and 10B are schematic illustrations of examples of sizes of triangular blocks, constructed and operative in accordance with a preferred embodiment of the present invention.
Figure 10B:
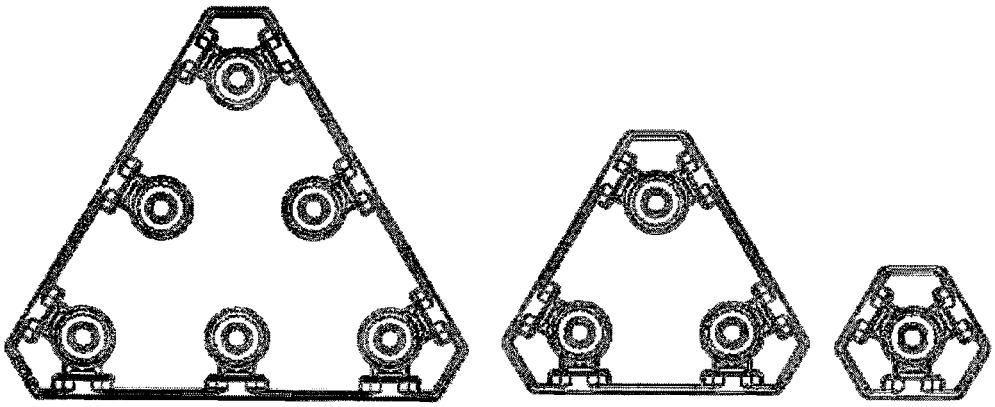
Figure 11A:
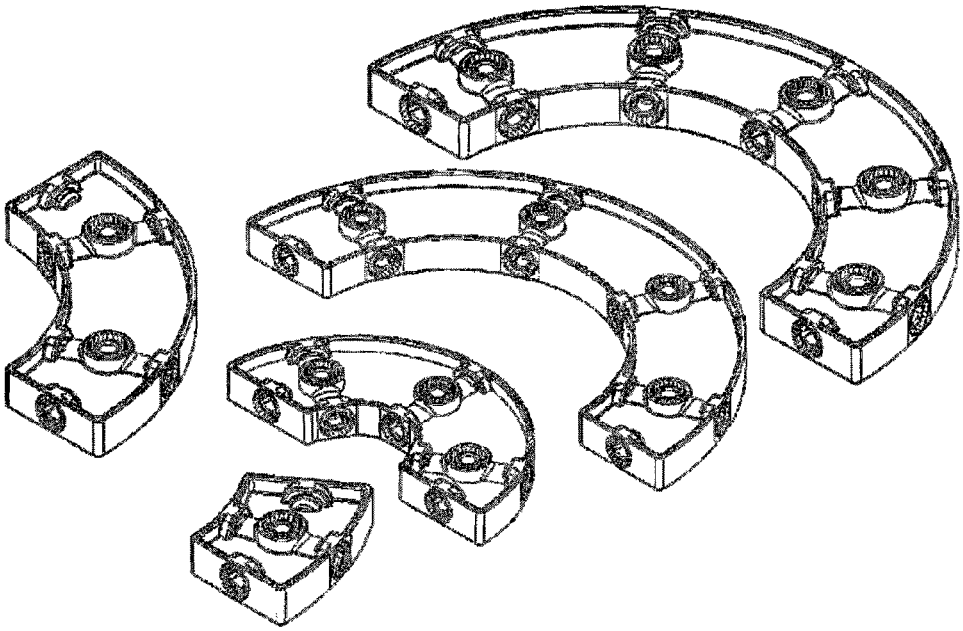
FIGS. 11A and 11B are schematic illustrations of examples of sizes of arc shaped blocks, constructed and operative in accordance with a preferred embodiment of the present invention.
Figure 11B:
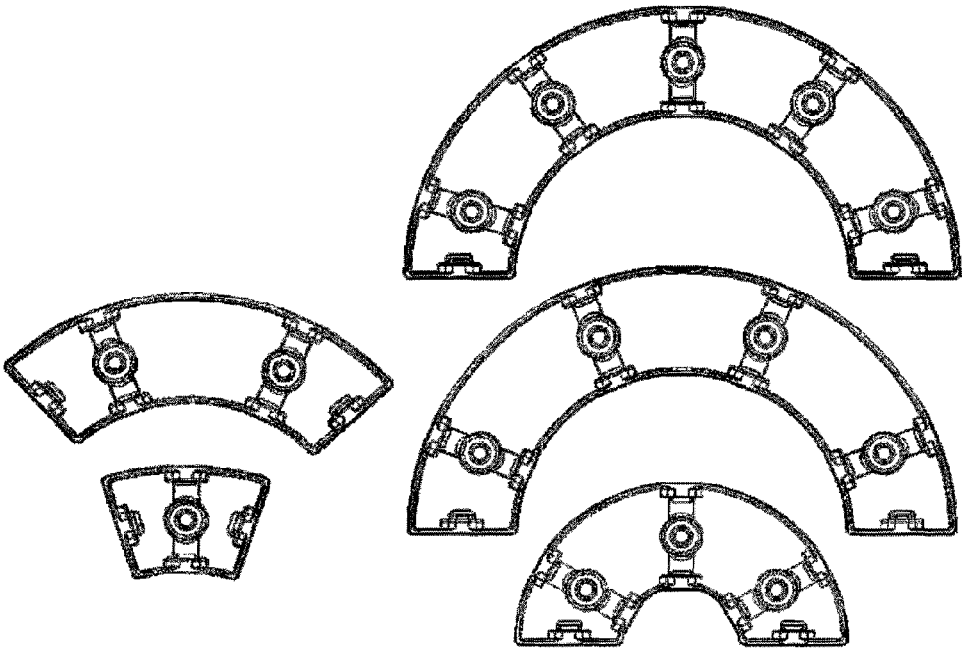

Reference is now made to FIGS. 8A, 8B, 9A, 9B, 10A, 10B, 11A and 11B which illustrate some of the different shapes and sizes that may be typically available for block 10. FIGS. 8A and 8B illustrate the rectangular range, FIGS. 9A and 9B illustrate the square range, FIGS. 10A and 10B illustrate the triangular range and FIGS. 11A and 11B illustrate the range of arc shaped blocks. As can be seen, the larger the block 10, the more holes 16 that may be available for connecting purposes.

It will be further appreciated that both block 10 and peg 12 may have alternative types, shapes and other configurations that may generally conform to the standard principles of the hole and peg connection as discussed herein above.

Block 10 may take the form of elements of the natural world (suns, moons, stars, plants and trees), may take the form of ornamental architectural pieces (arches, architraves, balusters, columns etc.) or may take the form of mechanical elements (wheels, gear wheels and cogs). Block 10 may also take the form of gears (spur, helical, double helical, double helical, skew, bevel, spiral bevel, worm, rack, pinion etc.) as well as geometrical 2D and 3D shapes (ellipses, hexagons, trapezoids, cubes, helixes etc.)

Figure 12:
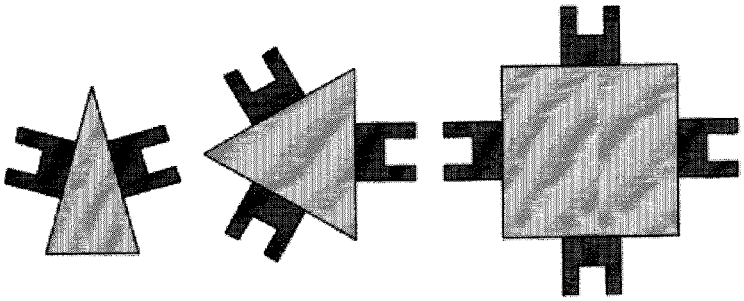
FIG. 12 is a schematic illustration of double, triple and quadruple-headed versions of the peg of FIGS. 2A and 2B, constructed and operative in accordance with a preferred embodiment of the present invention.

Peg 12 may take the form of a double, triple, quadruple or multi-headed peg with various orientations as is illustrated in FIG. 12 to which reference is now made, to allow for the construction of various angular orientations of blocks.

Figure 13:
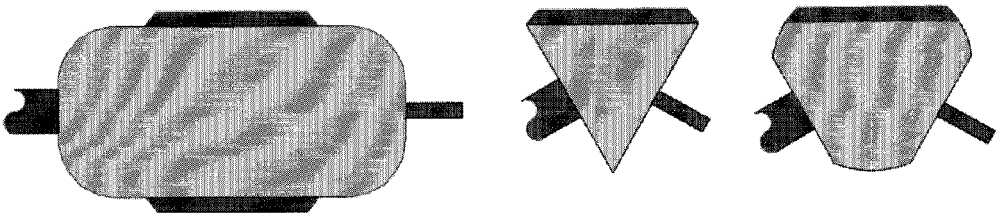
FIG. 13 is a schematic illustration of different shapes for the extraction tool of FIG. 6A, constructed and operative in accordance with a preferred embodiment of the present invention.

It will be appreciated that extraction tool 14 may also be of varying shape and size such as those illustrated in FIG. 13 to which reference is now made, to be used with the construction and disassembly of blocks 10 and pegs 12 as described in more detail herein above. Other shapes, such as a rectangular shape, are included in the present invention.

Thus, the present construction block system may provide a system to build strong, sturdy and large constructions where various blocks may be held at various angles to each other due to the angular connection provided by the ridged outer ring 18 and the ridges 32 on peg 12.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A kit for a construction toy, the kit comprising:

at least two construction blocks, wherein each said construction block comprises at least one hole, said at least one hole comprising a ridged outer ring; and at least one peg sized to fit within said at least one hole to connect between said at least two construction blocks with a cam-releasable snap-on connection, said at least one peg comprising at least two partially ridged outer rings to engage with said ridged outer ring of said at least one hole when said at least one peg is inserted into said at least one hole to securely hold said at least two construction blocks at a non-parallel angle, wherein said peg comprises:

two snap-on connections, each said connection to connect into said at least one hole in said construction blocks;

two pairs of cam-releasable elements, each pair to overcome its associated said snap-on connection thereby to enable said peg to be extracted from said construction blocks; and two inner rings, wherein said snap-on connections are on said inner rings and said cam-releasable elements are on said ridged outer rings of said peg.

2. The kit according to claim 1 and also comprising an extraction tool, said extraction tool comprising:

a wedge-shaped separation element to provide mechanical leverage between connected said at least two construction blocks to separate said two connected blocks;

an extraction tip comprising at least a curved and angled surface to engage with a curved and angled undersurface of said peg when said peg is engaged with one of said at least two construction blocks and to remove said peg.

3. The kit according to claim 1 and wherein each said construction block has multiple surfaces and said at least one hole is positioned on each surface of said construction block.

4. The kit according to claim 1 and wherein said inner rings of said peg comprise a split lip to catch underneath an extension of an inner ring of a hole of one of said at least two construction blocks and wherein the halves of said lip are pushed together when said peg is pushed into said hole.

5. The kit according to claim 1 and wherein said partially ridged outer rings have at least one tab with a curved and angled undersurface to receive a rotatable, curved and angled uppersurface, said uppersurface providing an upward force against said curved and angled undersurface, thereby to push said peg out of said block.

6. The kit according to claim 1 wherein said ridged outer ring of said at least one hole comprises a first multiplicity of first ridges, each spanning a predetermined angle, said partially ridge outer ring of said peg comprises a second multiplicity of second ridges, each spanning said predetermined angle, and wherein said non-parallel angle is a multiple of said predetermined angle.

7. The kit according to claim 1 and wherein the shape of said block is one of: square, rectangular, triangular and arc.

8. The kit according to claim 1 and wherein the shape of said block is one of: suns, moons, stars, plants and trees, arches, architraves, balusters, columns, wheels, gear wheels and cogs, spur, helical, double helical, double helical, skew, bevel, spiral bevel, worm, rack and pinion.

9. The kit according to claim 1 and wherein said peg is at least one of: double, triple, quadruple and multi-headed.

10. The kit according to claim 2 and wherein the shape of said extraction tool is at least one of: elliptical, square, triangular and rectangular.

11. A peg for connecting together two construction blocks, the peg comprising:

two snap-on connections each said connection to connect into a hole in one of said construction blocks;

two pairs of cam-releasable elements each pair to overcome its associated said snap-on connection thereby to enable said peg to be extracted from one of said blocks;

at least two partially ridged outer rings; and two inner rings, wherein said snap-on connections are on said inner rings and said cam-releasable elements are on said ridged outer rings.

12. The peg according to claim 11 and wherein said outer rings have at least one tab with a curved and angled undersurface to receive a rotatable, curved and angled uppersurface, said uppersurface providing an upward force against said curved and angled undersurface, thereby to push said peg out of said block.

13. The peg according to claim 11 and wherein said peg is at least one of: double, triple, quadruple and multi-headed.

* * * * *